US010488805B2

(12) United States Patent
Miyajima et al.

(10) Patent No.: US 10,488,805 B2
(45) Date of Patent: Nov. 26, 2019

(54) IMAGE FORMING APPARATUS

(71) Applicant: KONICA MINOLTA, INC., Chiyoda-ku, Tokyo (JP)

(72) Inventors: Satoshi Miyajima, Hino (JP); Takanobu Shiki, Sagamihara (JP); Hiroshi Oyama, Hino (JP); Remi Ishikawa, Kunitachi (JP); Tadayuki Ueda, Kokubunji (JP)

(73) Assignee: KONICA MINOLTA, INC., Tokyo (JP)

( * ) Notice: Subject to any disclaimer, the term of this patent is extended or adjusted under 35 U.S.C. 154(b) by 206 days.

(21) Appl. No.: 15/804,697

(22) Filed: Nov. 6, 2017

(65) Prior Publication Data

US 2018/0150014 A1 May 31, 2018

(30) Foreign Application Priority Data

Nov. 30, 2016 (JP) ..... 2016-231978

(51) Int. Cl.
*G03G 15/00* (2006.01)

(52) U.S. Cl.
CPC ..... *G03G 15/6502* (2013.01); *G03G 15/6561* (2013.01); *G03G 15/6511* (2013.01)

(58) Field of Classification Search
CPC ..... G03G 15/6567
USPC ..... 399/395
See application file for complete search history.

(56) References Cited

U.S. PATENT DOCUMENTS 9,599,943 B2 * 3/2017 Ishida ..... G03G 15/5029
2002/0017755 A1 * 2/2002 Dobberstein ..... B65H 9/002 271/227
2008/0054553 A1 * 3/2008 Muneyasu ..... B65H 9/004 271/240
2010/0264577 A1 * 10/2010 Suzuki ..... B65H 3/128 271/11
2011/0266742 A1 * 11/2011 Sato ..... B65H 5/36 271/228
2013/0134665 A1 * 5/2013 Asano ..... B65H 43/00 271/270

FOREIGN PATENT DOCUMENTS

JP 2015118138 A 6/2015

* cited by examiner

*Primary Examiner* — Anthony H Nguyen
(74) *Attorney, Agent, or Firm* — Holtz, Holtz & Volek PC

(57) ABSTRACT

An image forming apparatus includes the following. An upstream second conveying roller and a downstream second conveying roller form a loop on the long sheet. A deviation amount detector detects a deviation amount of the long sheet. A loop amount detector detects a loop amount in two positions in a width direction. A speed controller controls a rotating speed of the upstream second conveying roller and the downstream second conveying roller based on a deviation amount and a difference of loop amounts in two positions. Each of the upstream second conveying roller and the downstream second conveying roller includes a near roller and a far roller. The speed controller controls the rotating speed of the near roller and the far roller based on the deviation amount and the difference of the loop amounts in the two positions.

6 Claims, 9 Drawing Sheets

T1

| T11 SHEET TYPE | T12 BASIS WEIGHT [g/m$^2$] | T13 DEVIATION AMOUNT [mm] | T14 LOOP DIFFERENCE [mm] |
|---|---|---|---|
| HIGH STIFFNESS | 256 - | 0.4 | 0.5 |
| MEDIUM STIFFNESS | 128 - 255 | 0.5 | 0.6 |
| LOW STIFFNESS | - 127 | 0.8 | 0.7 |

T2

| T21 LOOP AMOUNT [mm] | T22 | T23 UPSTREAM LOOP ROLLER SPEED CONTROL AMOUNT [mm/s] | | T24 T25 DOWNSTREAM LOOP ROLLER SPEED CONTROL AMOUNT [mm/s] | T26 |
|---|---|---|---|---|---|
| NEAR | FAR | NEAR | FAR | NEAR | FAR |
| 1 | 1 | 440 | 440 | 440 | 440 |
| 1 | 2 | 440 | 430 | 440 | 420 |
| 1 | 3 | 440 | 420 | 440 | 400 |
| 2 | 1 | 430 | 440 | 420 | 440 |
| 2 | 2 | 420 | 420 | 420 | 420 |
| 2 | 3 | 420 | 410 | 420 | 400 |
| 3 | 1 | 420 | 440 | 400 | 440 |
| 3 | 2 | 410 | 420 | 400 | 420 |
| 3 | 3 | 400 | 400 | 400 | 400 |

T3

T31 T32 T33 T34 T35

| DEVIATION AMOUNT [mm] | UPSTREAM LOOP ROLLER SPEED CONTROL AMOUNT [mm/s] | | DOWNSTREAM LOOP ROLLER SPEED CONTROL AMOUNT [mm/s] | |
|---|---|---|---|---|
| | NEAR | FAR | NEAR | FAR |
| -4 | 440 | 450 | 450 | 440 |
| -3 | 440 | 447.5 | 447.5 | 440 |
| -2 | 440 | 445 | 445 | 440 |
| -1 | 440 | 442.5 | 442.5 | 440 |
| 0 | 440 | 440 | 440 | 440 |
| 1 | 442.5 | 440 | 440 | 442.5 |
| 2 | 445 | 440 | 440 | 445 |
| 3 | 447.5 | 440 | 440 | 447.5 |
| 4 | 450 | 440 | 440 | 450 |

IMAGE FORMING APPARATUS

BACKGROUND

1. Technological Field

The present invention relates to an image forming apparatus.

2. Description of the Related Art

Conventionally known image forming apparatuses using an electro-photographic method develops an electrostatic latent image formed on a photoreceptor with toner to form a toner image, transfers the formed toner image on a sheet, and thermally fixes the transferred toner image to form an image on the sheet.

In such image forming apparatuses, a registration roller is positioned right before a transfer roller which transfers a toner image on a sheet. When a front end of a sheet is placed against a nip line of the registration roller, a loop is formed in the sheet by sending the sheet a predetermined amount of time with the loop roller positioned right before the registration roller.

When the sheet is conveyed, due to variation in the certainty of components and change of quality of the components over time, the sheet may be deviated or bent. When such state occurs and the loop is formed, the loop is twisted. The following problems may occur, such as wrinkles forming in the sheet or the image forming position being displaced on the sheet.

In order to solve such problems, there is a technique to provide a detector which detects heights of the loop in at least two different positions of the loop formed in the sheet in the sheet width direction and detects the twist in the loop based on the difference in the detected height of the loop (for example, Japanese Patent Application Laid-Open Publication No. 2015-118138). According to such technique, when the twist in the loop is detected, pressuring force of both edges of the loop roller in the axis direction is adjusted to adjust the loop.

When a long sheet is conveyed, the sheet is conveyed with conveying rollers provided upstream and downstream of the loop rollers in a nipped state, and therefore, the sheet becomes firm. According to the above-described technique, the loop is adjusted with one pair of loop rollers. Therefore, there is not enough strength to match with the firm sheet, and it becomes difficult to adjust the loop with the plurality of conveying rollers in the nipped state. As a result, it is not possible to correct the sheets deviating or bending.

SUMMARY

An object of the present invention, which has been made in view of these problems described above, is to provide an image forming apparatus which is able to correct deviations and bends in the sheets to suppress wrinkles in the sheets and displacement of the image forming position even if the conveying rollers are in a nipped state.

To achieve at least one of the abovementioned objects, according to an aspect of the present invention, there is provided an image forming apparatus including an image forming unit which forms an image on a long sheet, the apparatus including: a first conveying roller; an upstream second conveying roller and a downstream second conveying roller which are positioned upstream than the first conveying roller in a conveying direction, which are positioned adjacent to each other in the conveying direction, and which form a loop on the long sheet; a deviation amount detector which is positioned upstream than the upstream second conveying roller in the conveying direction and which detects a deviation amount of the long sheet; a loop amount detector which is positioned upstream than the first conveying roller in the conveying direction, which is positioned downstream than the upstream second conveying roller in the conveying direction, and which detects a loop amount of a loop formed by at least one of the upstream second conveying roller and the downstream second conveying roller in two positions in a width direction; and a speed controller which controls a rotating speed of the upstream second conveying roller and the downstream second conveying roller based on a deviation amount detected by the deviation amount detector and a difference of loop amounts in two positions detected by the loop amount detector, wherein, each of the upstream second conveying roller and the downstream second conveying roller includes a near roller and a far roller positioned aligned in a direction orthogonal to the conveying direction, and the speed controller controls the rotating speed of the near roller and the far roller composing the upstream second conveying roller and the downstream second conveying roller based on the deviation amount and the difference of the loop amounts in the two positions.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
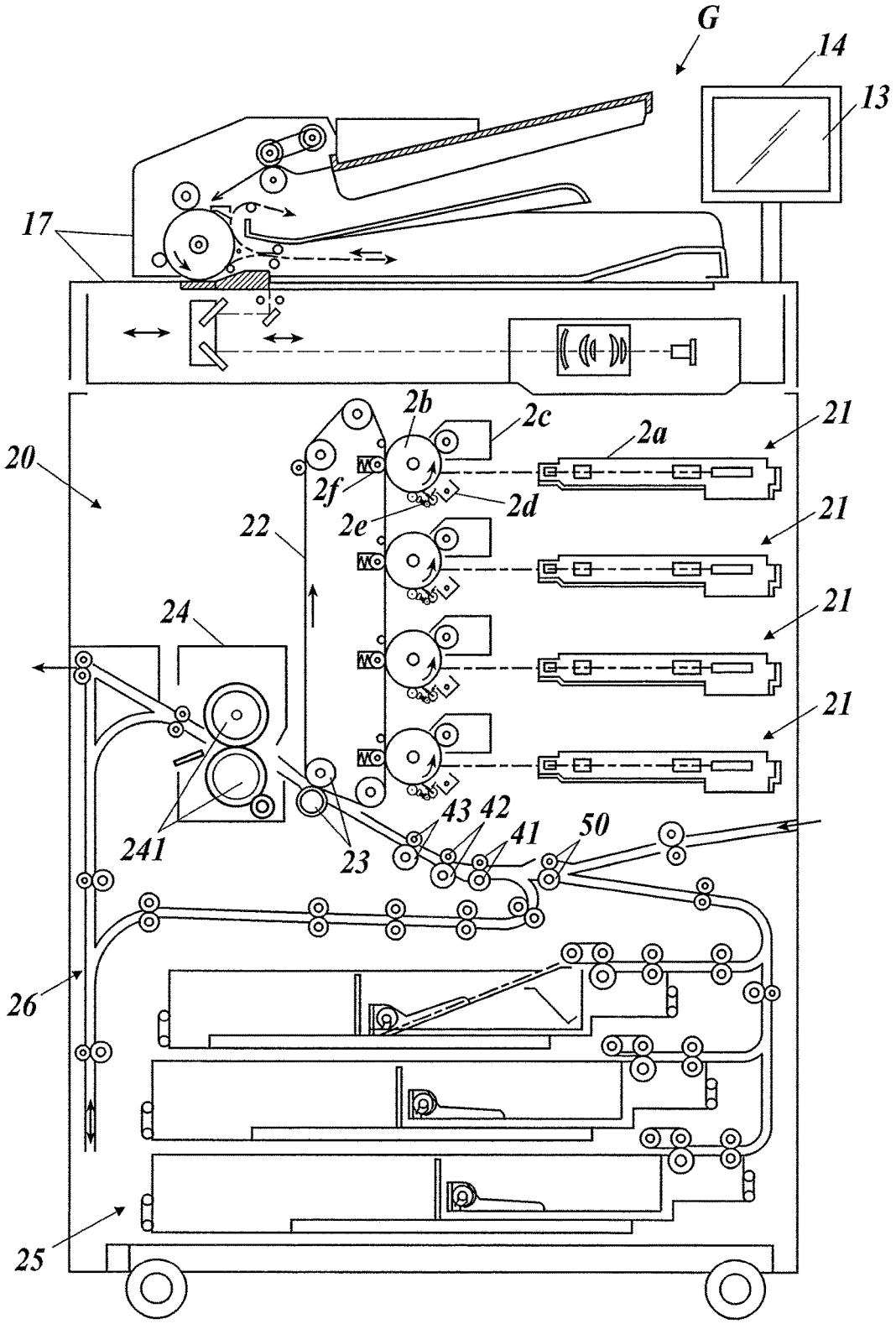
FIG. 1 is a front view showing a schematic configuration of an image forming apparatus according to the present embodiment.

As shown in FIG. 1, the image forming apparatus G according to the present embodiment includes an image forming unit 20, and the image forming unit 20 forms an image on a sheet using a color material such as toner. The image forming apparatus G is able to perform image forming on a long sheet (continuous sheet). The long sheet is a sheet which is longer than a predetermined length in a longitudinal direction, and typically the length of the sheet in the longitudinal direction is a few meters to a few tens of meters. From hereinafter, the long sheet may simply be referred to as a sheet.

Figure 2:
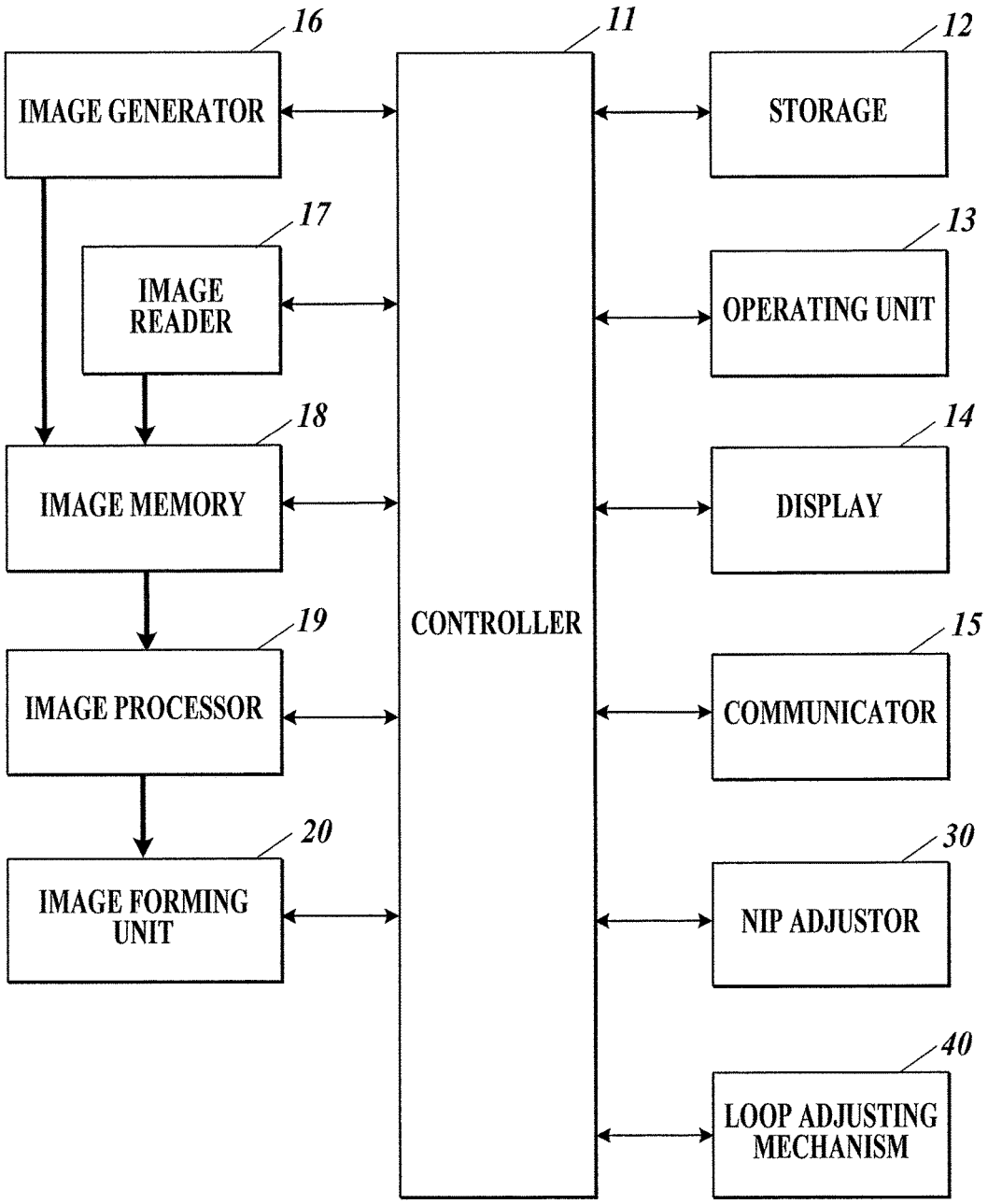
FIG. 2 is a functional block diagram showing a control structure of the image forming apparatus according to the present embodiment.

As shown in FIG. 1 and FIG. 2, the image forming apparatus G includes a controller 11, a storage 12, an operating unit 13, a display 14, a communicator 15, an image generator 16, an image reader 17, an image memory 18, an image processor 19, an image forming unit 20, a nip adjuster 30, and a loop adjusting mechanism 40.

The controller 11 includes a CPU, a RAM, etc. The controller 11 reads various programs from the storage 12 to perform the programs and controls each unit. For example, the controller 11 uses the image processor 19 to process an original image generated by the image generator 16 or the image reader 17 and held by the image memory 18, and uses the image forming unit 20 to form the image on the sheet based on the processed original image.

The storage 12 stores the program readable by the controller 11 and the file used when the program is performed. As the storage 12, a mass memory such as a hard disk can be used.

As shown in FIG. 1, the operating unit 13 and display 14 are provided in an upper portion of the image forming apparatus G as a user interface.

The operating unit 13 generates the operating signal according to the operation of the user and outputs the signal to the controller 11. A keypad, a touch panel formed as one with the display 14, etc. can be used as the operator 13.

The display 14 displays the operating screen, etc. according to the instruction of the controller 11. An LCD (Liquid Crystal Display), OELD (Organic Electro Luminescence Display), etc. are used as the display 14.

The communicator 15 communicates with an external apparatus on the network, for example, a user terminal, server, other image forming systems, etc. The communicator 15 receives through the network from the user terminal vector data in which instructions to form an image are described in a page description language (PDL).

The image generator 16 performs rasterizing processing on the vector data received by the communicator 15 and generates an original image in a bitmap format. Each pixel of the original image includes pixel values of four colors of C (cyan), M (magenta), Y (yellow), and K (black). The pixel value is a data value showing intensity of the image and for example, data value of 8 bits show intensity of 0 to 255 gradations.

As shown in FIG. 1, the image reader 17 includes an automatic document feeding apparatus, a scanner, etc. The image reader 17 reads the document surface set on the document stage and generates the original image in a bitmap format. Each pixel of the original image generated by the image reader 17 includes pixel values of three colors of R (red), G (green), and B (blue). The colors of the original image are converted so that the original image includes pixel values of the four colors of C, M, Y and K using a color converter (not shown).

The image memory 18 is a buffer memory which temporarily holds the original image generated by the image generator 16 or image reader 17. A DRAM (Dynamic RAM), etc. can be used as the image memory 18.

The image processor 19 reads the original image from the image memory 18 and performs image processing such as an intensity correction process, half tone process and the like. The density correction process is a process which converts the pixel value of each pixel in the original image to a pixel value corrected so that the density of the image formed on the sheet matches with the target density. The intermediate process is a process for pseudo reproduction of half tone and includes processes such as error diffusion process, a screen process using a systematic dither method, and the like.

The image forming unit 20 forms on the sheet an image including four colors of C, M, Y and K according to the pixel values of the four colors in each pixel of the original image on which image processes are performed by the image processor 19.

As shown in FIG. 1, the image forming unit 20 includes four writing units 21, an intermediate transfer belt 22, a pair of secondary transfer rollers 23, a fixing apparatus 24, a sheet feeding tray 25, and the like.

The four writing units 21 are positioned in a series (tandem) along a belt face of the intermediate transfer belt 22 and form the images of each color of C, M, Y and K. With the exception of the color of the image formed, the configuration of the writing units 21 are the same. As shown in FIG. 1, the writing unit 21 includes an optical scanning apparatus 2*a*, a photoreceptor 2*b*, a developer 2*c*, a charging unit 2*d*, a cleaning unit 2*e* and a primary transfer roller 2*f*.

When the image is formed, in each writing unit 21, after the photoreceptor 2*b* is charged by the charging unit 2*d*, the beam of light emitted by the optical scanning apparatus 2*a* scans the photoreceptor 2*b* and an electrostatic latent image is formed based on the original image. When color material such as toner is supplied and the image is developed by the developer 2*c*, the image is formed on the photoreceptor 2*b*.

Each image formed on the photoreceptor 2*b* of the four writing units 21 are transferred (primary transfer) overlapped sequentially on the intermediate transfer belt 22 by each primary transfer roller 2*f*. With this, the image including each color is formed on the intermediate transfer belt 22. The intermediate transfer belt 22 is a rotating image carrier rotated by a plurality of rollers. After the primary transfer, the cleaning unit 2*e* removes the residual color materials remaining on the photoreceptor 2*b*.

The image forming unit 20 feeds the sheet from the long sheet feeding apparatus (not shown) or sheet feeding tray 25 to match with the timing that the image on the rotating intermediate transfer belt 22 reaches the position of the pair of secondary transfer rollers 23. One of the pair of secondary transfer rollers 23 comes into contact with pressure to the intermediate transfer belt 22 and the other secondary transfer roller 23 composes one of the plurality of rollers which rotate the intermediate transfer belt 22. When the pair of secondary transfer rollers 23 is pressed against the intermediate transfer belt 2 and the image is transferred (secondary transfer) onto the sheet from the intermediate transfer belt 22, the sheet is conveyed to the fixing apparatus 24 to perform the fixing process. Then, the sheet is ejected outside of the image forming apparatus G (for example, winding apparatus which winds and collects the long sheet, sheet ejecting tray for cut sheet, etc.). In the fixing process, the pair of fixing rollers 241 apply heat and pressure to the sheet to fix the image on the sheet. When the image is formed on both faces of the sheet, after the sheet is conveyed to the inverting path 26 and the sheet face is turned over, the sheet is fed again to the position of the pair of secondary transfer rollers 23.

According to control from the controller 11, the nip adjuster 30 controls the nipping state of the various conveying rollers by operating the various conveying rollers which convey the sheet (conveying roller 50, upstream loop roller 41, downstream loop roller 42, registration roller 43, etc.) to be separated or to be pressed to each other.

Figure 3:
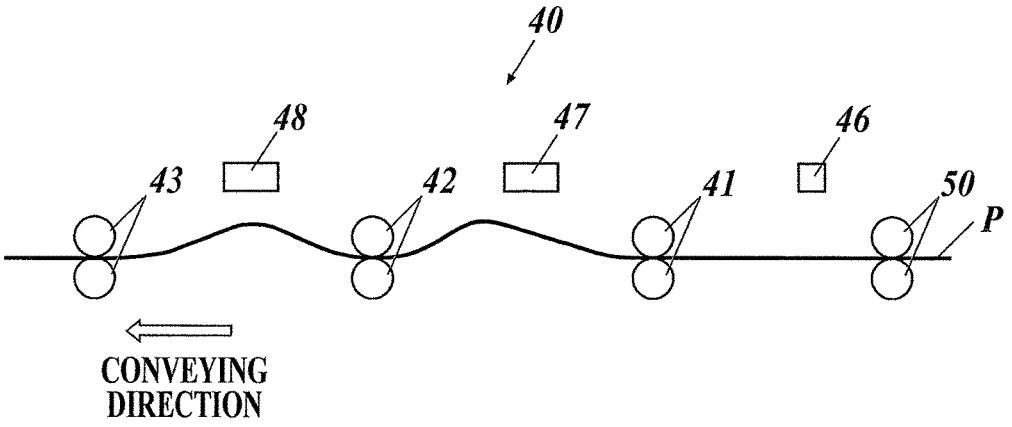
FIG. 3 is a front view showing a configuration of a loop adjustment mechanism.
Figure 4:
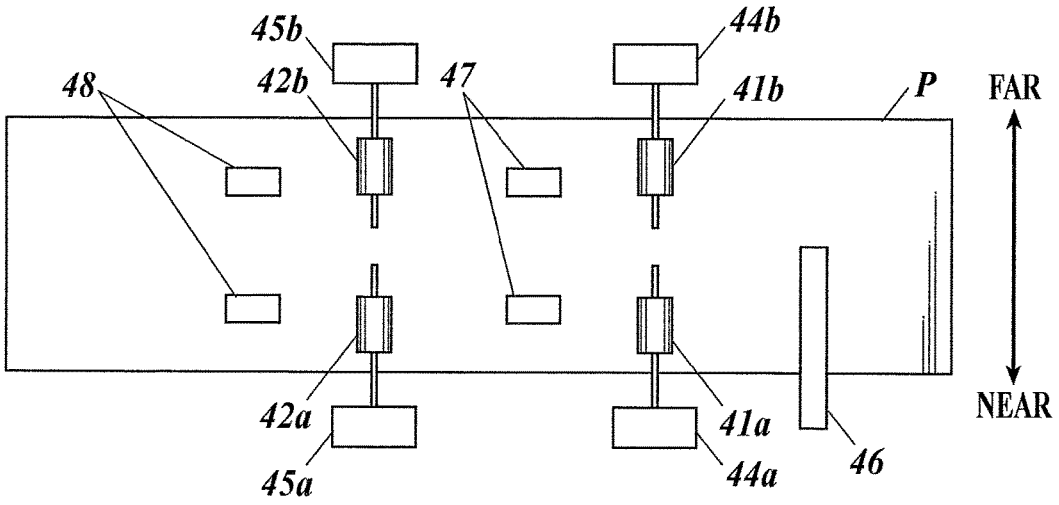
FIG. 4 is a planar view showing a configuration of a loop adjustment mechanism.

As shown in FIG. 3 and FIG. 4, the loop adjustment mechanism 40 includes an upstream loop roller (upstream second conveying roller) 41 including two rollers 41*a*, 41*b* positioned downstream the conveying roller 50 in the conveying direction, and positioned aligned in a direction orthogonal to the conveying direction (sheet width direction); a downstream loop roller (downstream second conveying roller) 42 including two rollers 42*a*, 42*b* positioned downstream the conveying direction of the upstream loop roller 41 and positioned aligned in the sheet width direction; a registration roller 43 (first conveying roller) positioned downstream the downstream loop roller 42 in the conveying direction; drivers 44*a*, 44*b* which each independently drive each of the two rollers 41*a*, 41*b* composing the upstream loop roller 41; drivers 45*a*, 45*b* which each independently drive each of the two rollers 42*a*, 42*b* composing the downstream loop roller 42; deviation sensor (deviation amount detector) 46 provided between the conveying roller 50 and upstream loop roller 41; first loop detecting sensors (loop amount detector) 47 positioned between the upstream loop roller 41 and the downstream loop roller 42; and second loop detecting sensors (loop amount detector) 48 positioned between the downstream loop roller 42 and registration roller 43. Reference numeral P shown in FIG. 3 and FIG. 4 show the conveyed sheet (long sheet).

The controller 11 controls the drivers 44*a*, 44*b* so that the rotating speed (conveying speed) of the upstream loop roller 41 becomes faster than the downstream loop roller 42, and the loop L1 is formed in the sheet between the upstream loop roller 41 and the downstream loop roller 42.

The controller 11 controls the drivers 45*a*, 45*b* so that the rotating speed (conveying speed) of the downstream loop roller 42 becomes faster than the registration roller 43, and the loop L2 is formed in the sheet between the downstream loop roller 42 and the registration roller 43.

The upstream loop roller 41 and the downstream loop roller 42 are positioned upstream than the first conveying roller in the conveying direction and adjacent to each other in the conveying direction.

The deviation sensor 46 includes a line sensor and detects the sheet deviation amount (that is, the position shift amount in the sheet width direction) based on whether light is blocked by the sheet conveyed on the conveying path.

Two first loop detecting sensors 47 are positioned aligned in the sheet width direction, and detect the height (loop amount) of the loop L1 formed between the upstream loop roller 41 and downstream loop roller 42 in two positions in the width direction. Here, the loop amount is the distance in the shift between the sheet conveying path which the sheet with tension passes when the sheet is conveyed and the sheet conveying path which the sheet actually passed when the sheet is conveyed.

Two second loop detecting sensors 48 are positioned aligned in the sheet width direction, and detect the loop amount of the loop L2 formed between the downstream loop roller 42 and the registration roller 43 in two positions in the width direction.

The controller 11 is able to detect bends in the sheet when the loop amount is different in the two positions detected by each of the first loop detecting sensors 47 and the second loop detecting sensors 48.

Figure 5:
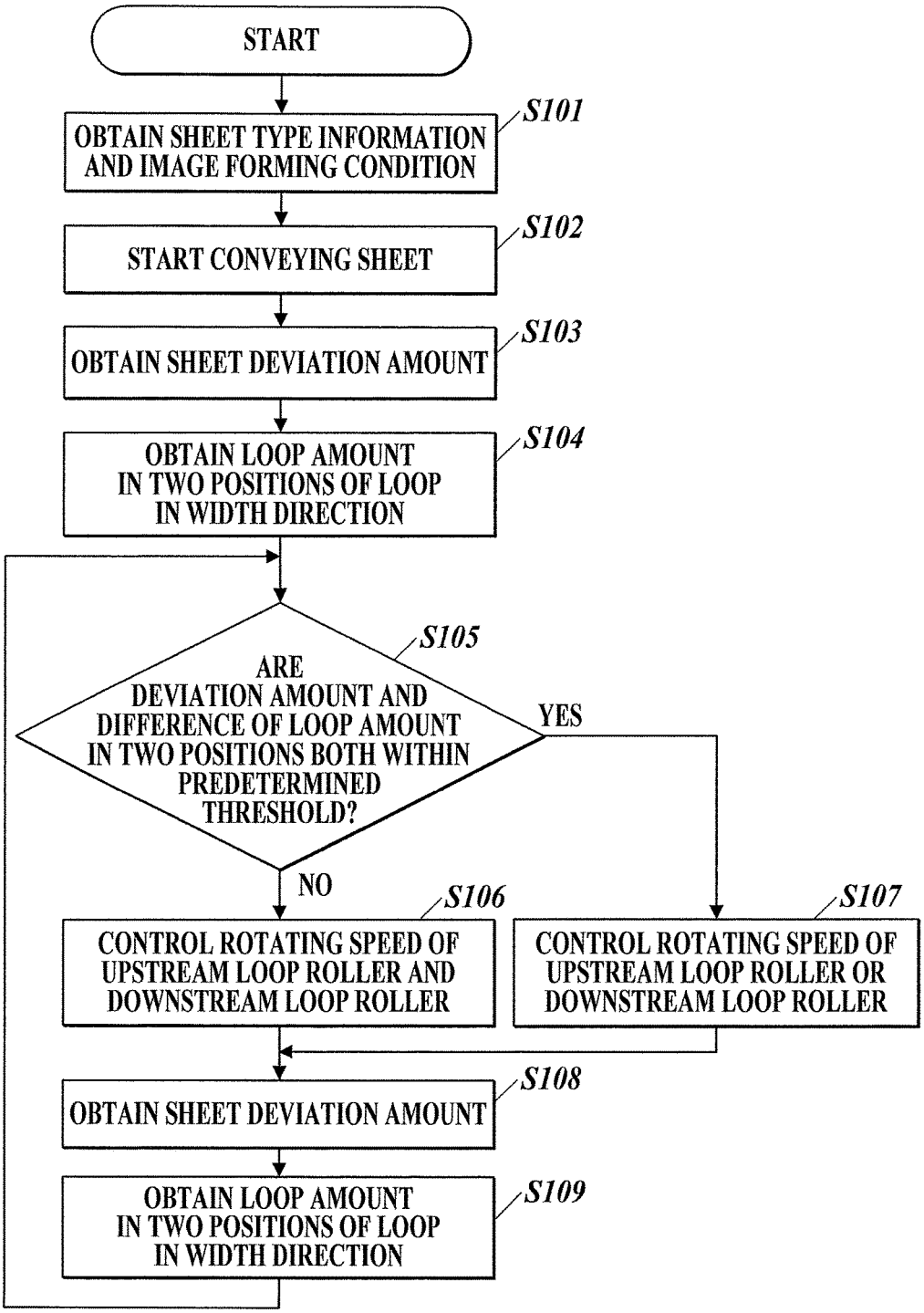
FIG. 5 is a flowchart showing an operation of an image forming apparatus according to the present embodiment.

Next, the operation of the image forming apparatus G according to the present embodiment is described with reference to the flowchart shown in FIG. 5. This operation is started when the controller 11 receives the print job.

First, the controller 11 obtains sheet type information and image forming conditions based on the received print job (step S101). Here, the sheet type information includes information such as size of the used sheet, type of the used sheet, basis weight of the used sheet, and the like. Image forming conditions include information such as the sheet feeding tray to which the sheet is fed, whether color printing is performed or not, whether one surface or both surfaces are printed, and the like.

Next, the controller 11 starts conveying the sheet (step S102).

Next, the controller 11 obtains the sheet deviation amount detected by the deviation sensor 46 (step S103). Next, the controller 11 obtains the loop amount of loop L1 in two positions in the width direction detected by the first loop sensor 47 (step S104).

Next, the controller 11 determines whether the deviation amount obtained in step S103 and the difference of the loop amount in two positions obtained in step S104 (loop difference) are within the predetermined threshold (step S105). Here, the predetermined threshold is determined in advance according to the sheet type.

Figures 6, 7:
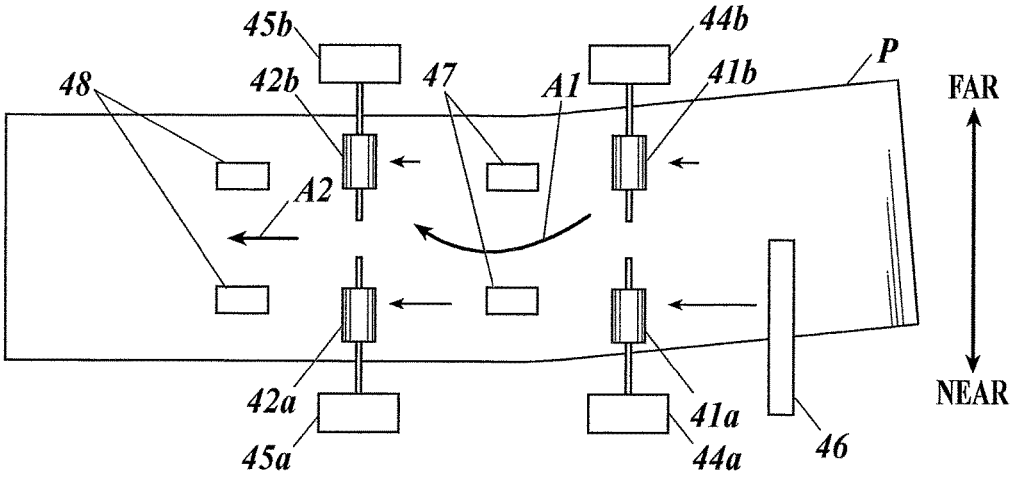
FIG. 6 is a diagram showing an example of a table showing a threshold specified according to sheet type.
FIG. 7 is a diagram showing an example of controlling so that among the upstream loop rollers, rotating speed of a far roller is slower than a rotating speed of a near roller.

FIG. 6 shows an example of a table T1 showing the threshold set for each sheet type.

The table T1 includes fields such as sheet type T11, sheet basis weight T12, deviation amount threshold T13, and loop difference threshold T14. For example, it is possible to read from the record when the sheet type T11 is "high stiffness" that the basis weight T12 is "256 g/m$^2$-", the deviation amount threshold T13 is "0.4 mm", and the loop difference threshold T14 is "0.5 mm". It is possible to read from the record when the sheet type T11 is "intermediate stiffness" that the basis weight T12 is "128 g/m$^2$-255 g/m$^2$", the deviation amount threshold T13 is "0.5 mm", and the loop difference threshold T14 is "0.6 mm". It is possible to read from the record when the sheet type T11 is "low stiffness" that the basis weight T12 is "−127 g/m$^2$", the deviation amount threshold T13 is "0.8 mm", and the loop difference threshold T14 is "0.7 mm".

When the controller 11 determines both the deviation amount and the loop difference are within a predetermined threshold (step S105: YES), the process advances to step S107.

When the controller 11 determines at least one of the deviation amount or the loop difference is outside a predetermined threshold (step S105: NO), the process advances to the next step S106.

Next, the controller 11 controls the rotating speed of the upstream loop roller 41 and the downstream loop roller 42 based on the deviation amount obtained in step S103 and the loop difference obtained in step S104 (step S106). That is, the controller 11 functions as the speed controller of the present invention.

[Control to Correct Sheet Loop Difference (Bend)]

Figures 8, 9:
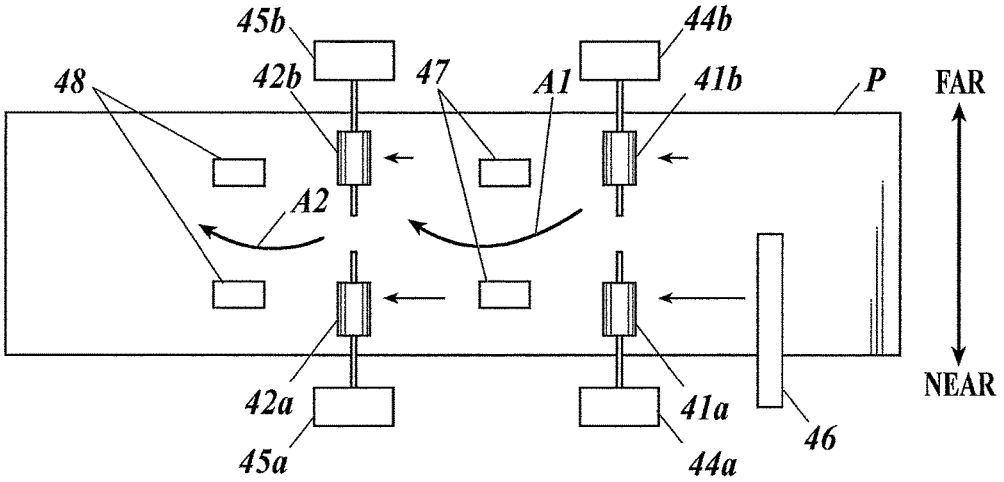
FIG. 8 is a diagram showing an example of controlling so that among the downstream loop rollers, rotating speed of a far roller is slower than a rotating speed of a near roller.
FIG. 9 is a diagram showing an example of a table showing a relation between sheet loop amount and amount of speed control of the upstream loop roller and the downstream loop roller.

In step S106, the control to correct the sheet loop difference (bend) is described using FIG. 7 and FIG. 8. The example shown in FIG. 7 and FIG. 8 shows the bend occurring in the far side of the sheet in the width direction (that is, the sheet is bent to the far side). Further, the reference numerals A1, A2 shown in FIG. 7 and FIG. 8 show a direction to which the conveying force is applied by the upstream loop roller 41 and the downstream loop roller 42.

First, the controller 11 controls the rotating speed of the upstream loop roller 41. For example, as shown in FIG. 7, when the sheet is bent in the far side, among the upstream loop rollers 41, the controller 11 controls the rotating speed of the roller at the far side of the sheet (hereinafter referred to as far roller) 41*b* to be slower than the rotating speed of the roller at the near side of the sheet (hereinafter referred to as near roller) 41*a*.

FIG. 9 shows an example of a table T2 showing a relation between a sheet loop amount and a speed control amount of the upstream loop rollers 41 and the downstream loop rollers 42.

The table T2 includes fields such as sheet near and far loop amount T21, T22, speed control amount T23, T24 of the near roller 41*a* and far roller 41*b* of the upstream loop roller 41, and speed control amount T25, T26 of the near roller 42*a* and far roller 42*b* of the downstream loop roller 42. For example, it is possible to read from the first record of the table T2 when the sheet near and far loop amount T21, T22 are both "1 mm" that the speed control amount T23, T24 of the near roller 41*a* and far roller 41*b* of the upstream loop roller 41 and the speed control amount T25, T26 of the near roller 42*a* and far roller 42*b* of the downstream loop roller 42 are all "440 mm/s". It is possible to read from the second record of the table T2 when the sheet near and far loop amount T21, T22 are each respectively, "1 mm", "2 mm", that the speed control amount T23, T24 of the near roller 41*a* and far roller 41*b* of the upstream loop roller 41 are each "440 mm/s", "430 mm/s", respectively, and the speed control amount T25, T26 of the near roller 42*a* and far roller 42*b* of the downstream loop roller 42 are each "440 mm/s", "420 mm/s" respectively.

Therefore, for example, when the near loop amount T21 of the loop L1 is 1 mm and the far loop amount T22 is 2 mm, the controller 11 controls the rotating speed (speed control amount T23, T24) of the near roller 41*a* and the far roller 41*b* of the upstream loop roller 41 to be "440 mm/s" and "430 mm/s", respectively.

Next, the controller 11 controls the rotating speed of the downstream loop roller 42. For example, when the sheet is bent in the far side (see FIG. 7) as shown in FIG. 8, among the downstream loop rollers 42, the controller 11 controls the rotating speed of the far roller 42*b* to be slower than the rotating speed of the near roller 41*a*.

For example, when the near loop amount T21 of the loop L1 is 1 mm, and the far loop amount T22 is 2 mm, the controller 11 controls the rotating speed of the near roller 42*a* and the far roller 42*b* of the downstream loop roller 42 (speed control amount T25, T26) to be "440 mm/s", "420 mm/s" respectively (see FIG. 9).

According to the above control, the loop difference (bend) of the sheet can be corrected.

According to the example shown in FIG. 9, when the difference between the loop amount of the two positions exceeds a predetermined threshold, the rotating speed difference between the near roller 41*a* and the far roller 41*b* composing the upstream loop roller 41 is controlled to be smaller than the rotating speed difference of the near roller 42*a* and the far roller 42*b* composing the downstream loop roller 42, but the present invention is not limited to the above. That is, the rotating speed difference between the near roller 41 and the far roller 41*b* composing the upstream loop roller 41 can be controlled to be larger than the rotating speed difference between the near roller 42*a* and the far roller 42*b* composing the downstream loop roller 42. With this, after a rough correction by the upstream loop rollers 41, fine adjustment can be performed with the downstream loop roller 42.

[Control to Correct Deviation Amount of Sheet]

Figure 10:
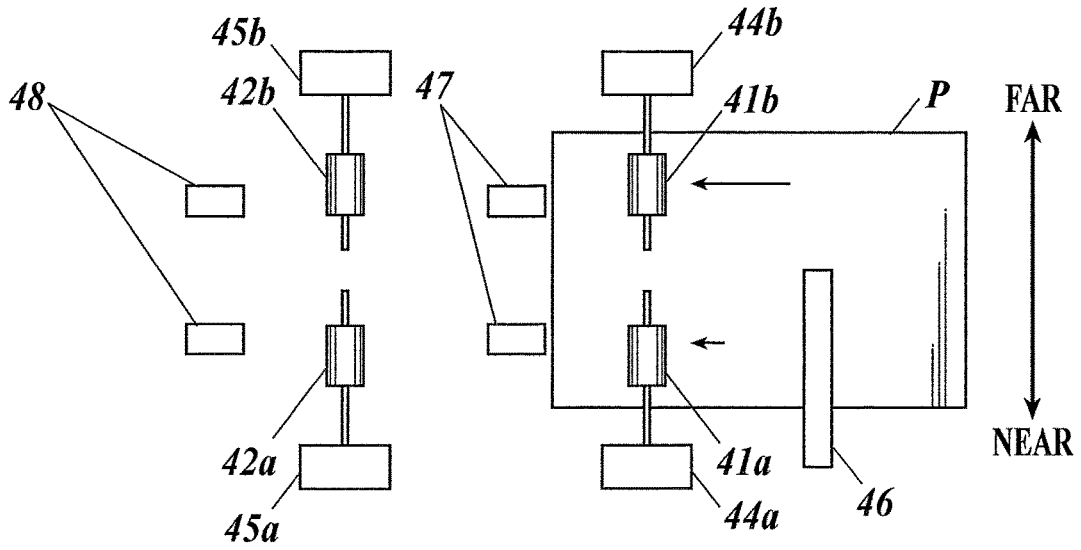
FIG. 10 is a diagram showing an example of controlling so that among the upstream loop rollers, rotating speed of a far roller is faster than a rotating speed of a near roller.
Figure 11:
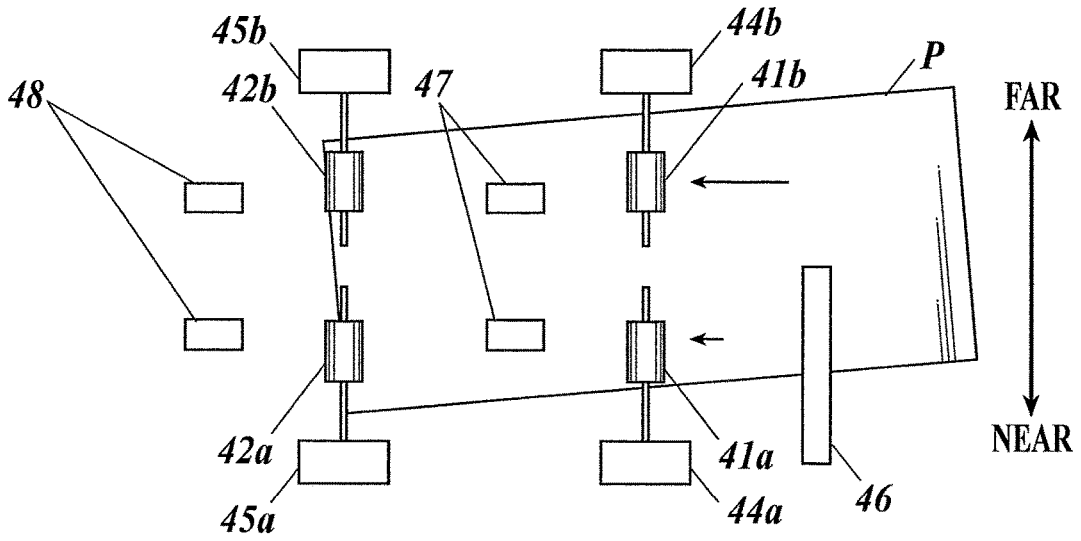
FIG. 11 is a diagram showing an example of the far side of the sheet bending.
Figures 12, 13:
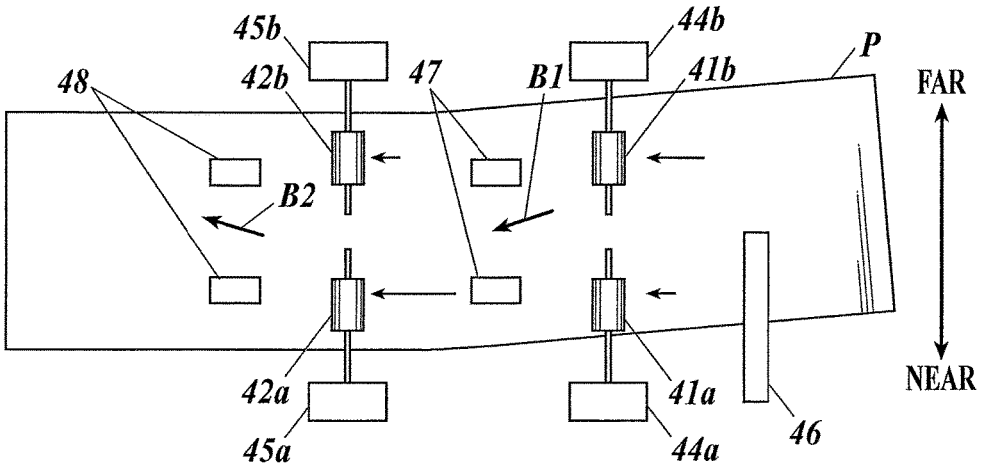
FIG. 12 is a diagram showing an example of controlling so that among the downstream loop rollers, rotating speed of a far roller is slower than a rotating speed of a near roller.
FIG. 13 is a diagram showing an example of a table showing a relation between a sheet deviation amount and amount of speed control of the upstream loop roller and the downstream loop roller.

The control to correct the deviation amount of the sheet in step S106 is described using FIG. 10 to FIG. 12. According to the example shown in FIG. 10 to FIG. 12, the deviation occurs in the far side of the sheet (that is, the sheet is deviated to the far side). The reference numerals B1 and B2 shown in FIG. 12 show the direction that the conveying power is applied by the upstream loop rollers 41 and the downstream loop rollers 42.

First, the controller 11 controls the rotating speed of the upstream loop roller 41 to bend the sheet. For example, as shown in FIG. 10, when the deviation occurs in the far side of the sheet, among the upstream loop rollers 41, the controller 11 controls the rotating speed of the far roller 41*b* to be faster than the rotating speed of the near roller 41*a* to cause the bend to the far side of the sheet.

FIG. 13 shows an example of table T3 showing a relation between the sheet deviation amount and the speed control amount of the upstream loop roller 41 and the downstream loop roller 42.

The table T3 includes fields such as sheet deviation amount T31, speed control amount T32, T33 of the near roller 41*a* and far roller 41*b* of the upstream loop roller 41, and speed control amount T34, T35 of the near roller 42*a* and the far roller 42*b* of the downstream loop roller 42. As for the sheet deviation amount T31, with reference to the center position (reference position), a minus sign is applied when deviated in the far side and a plus sign is applied when deviated in the near side. For example, it is possible to read from the first record of the table T3 that when the sheet deviation amount T31 is "−4 m", the speed control amount T32, T33 of the near roller 41*a* and the far roller 41*b* of the upstream loop roller 41 is "440 mm/s", "450 mm/s", and the speed control amount T34, T35 of the near roller 42*a* and the far roller 42*b* of the downstream loop roller 42 is "450 mm/s", "440 mm/s". It is possible to read from the second record of table T3 that when the sheet deviation amount T31 is "−3 mm", the speed control amount T32, T33 of the near roller 41*a* and far roller 41*b* of the upstream loop roller 41 is "440 mm/s", "447.5 mm/s", and the speed control amount T34, T35 of the near roller 42*a* and the far roller 42*b* of the downstream loop roller 42 is "447.5 mm/s", "440 mm/s".

Therefore, for example, when the sheet deviation amount T31 is −4 mm (that is, the sheet is deviated in the far side 4 mm), the controller 11 controls the rotating speed of the near roller 41*a* and the far roller 41*b* (speed control amount T32, T33) of the upstream loop roller 41 to be "440 mm/s", "450 mm/s" respectively. With this, the sheet can be bent in the far side (see FIG. 11).

Next, the controller 11 controls the rotating speed of the downstream loop rollers 42. For example, when the sheet is bent in the far side of the sheet (see FIG. 11), as shown in FIG. 12, among the downstream loop rollers 42, the controller 11 controls the rotating speed of the far roller 42*b* to be slower than the rotating speed of the near roller 42*a*.

For example, when the sheet deviation amount T31 is −4 mm, the controller 11 controls the rotating speed of the near roller 42*a* and the far roller 42*b* (speed control amount T34, T35) of the downstream loop roller 42 to be "450 mm/s", "440 mm/s" (see FIG. 13).

According to the above control, the bend and the deviation in the sheet can be corrected.

That is, when the controller 11 controls correction of the sheet deviation amount, based on the deviation amount, after the rotating speed of the near roller 41*a* and the far roller 41*b* composing the upstream loop roller 41 is controlled, the relation of which has a faster rotating speed between the near roller 42*a* and the far roller 42*b* composing the downstream loop roller 42 is controlled to be opposite the relation of which has a faster rotating speed between the near roller 41*a* and the far roller 41*b* composing the upstream loop roller 41.

In step S107, based on the deviation amount obtained in step S103 and the loop difference obtained in step S104, the controller 11 controls the rotating speed of the upstream loop roller 41 or the downstream loop roller 42.

For example, when the controller 11 controls correction of the loop difference (bend) of the sheet, the rotating speed of the upstream loop rollers 41 or the downstream loop rollers 42 are controlled so that the rotating speed of the roller in which the bend occurs (far roller when bent in the far side) becomes slower than the rotating speed of the roller in which the bend does not occur (near roller when bent in the far side). According to the above control, the loop difference (bend) of the sheet can be corrected.

When the controller 11 controls correction of the deviation of the sheet, first the controller 11 controls the rotating speed of the upstream loop rollers 41 or the downstream loop rollers 42 so that the rotating speed of the roller in which the deviation occurs (far roller when the deviation occurs in the far side) is to be slower than the rotating speed of the roller in which the deviation does not occur (near roller when the deviation occurs in the far side) and bends the sheet in the side where the deviation occurs. Next, the rotating speed of the upstream loop rollers 41 or the downstream loop rollers 42 is controlled so that the roller in which the bend occurs (far roller when bent in the far side) becomes slower than the rotating speed of the roller in which the bend does not occur (near roller when bent in the far side). According to the above control, the bend and the deviation of the sheet can be corrected.

Next, the controller 11 obtains the deviation amount of the sheet detected by the deviation sensor 46 (step S108).

Next, the controller 11 obtains the loop amount of the loop L2 detected by the second loop detecting sensor 48 in two positions in the width direction (step S109). Instead of the loop amount of the loop L2 in two positions in the width direction, the loop amount of the loop L1 detected by the first loop detecting sensor 47 in two positions in the width direction can be obtained.

Next, the controller 11 advances the process to step S105, and determines whether both the deviation amount obtained in step 5108 and the difference of the loop amount in two positions obtained in step S109 (loop difference) are both within a predetermined threshold. With this, it is possible to feed back the result of the correction process in step S106 or step S107 in real time. Hereinafter, the process of steps S105 to S109 is repeated until the print job ends.

When the deviation amount obtained in step S108 and the difference of the loop amount in two positions obtained in step S109 (loop difference) are both "0 mm", there is no need to correct the bend and the deviation of the sheet. Therefore, the controller 11 controls the rotating speed of the upstream loop rollers 41 and the downstream loop rollers 42 to be a normal speed.

As described above, the image forming apparatus G according to the present embodiment includes a first conveying roller (registration roller 43), an upstream second conveying roller (upstream loop roller 41) and downstream second conveying roller (downstream loop roller 42) which are positioned adjacent to each other upstream than the first conveying roller in the conveying direction and which form a loop in the long sheet, a deviation amount detector (deviation sensor 46) which is positioned upstream than the upstream second conveying roller in the conveying direction and which detects the deviation amount of the long sheet, a loop amount detector (first loop detecting sensor 47, second loop detecting sensor 48) which is positioned upstream than the first conveying roller in the conveying direction and downstream than the upstream second conveying roller in the conveying direction and which detects the loop amounts in two positions in the width direction in the loop formed by at least one of the upstream second conveying roller and the downstream second conveying roller, and a speed controller (controller 11) which controls the rotation speed of the upstream second conveying roller and the downstream second conveying roller based on the deviation amount detected by the deviation amount detector and the difference between the loop amount of the two positions detected by the loop amount detector. Moreover, each of the upstream second conveying roller and the downstream second conveying roller include a near roller (near rollers 41*a*, 42*a*) and a far roller (far rollers 41*b*, 42*b*) positioned aligned in a direction orthogonal to the conveying direction and the speed controller controls the rotating speed of the near roller and the far roller composing each of the upstream second conveying roller and the downstream second conveying roller based on the deviation amount and the difference of the loop amount of the two positions.

Therefore, according to the image forming apparatus G of the present embodiment, even if the conveying roller is nipped, the deviation and the bend occurring in the sheet can be corrected. Consequently, it is possible to prevent wrinkles in the sheet and displacement of the image forming position.

According to the image forming apparatus G of the present embodiment, the speed controller separately controls the rotating speed of the near roller and the far roller of the upstream second conveying roller and the downstream second conveying roller.

Therefore, according to the image forming apparatus G of the present embodiment, the deviation and the bend of the sheet can be corrected step by step. Consequently, the sheet can be corrected accurately without providing a burden on the sheet.

According to the image forming apparatus G of the present embodiment, when the deviation amount or the difference in the loop amount in two positions exceeds a predetermined threshold, the speed controller controls so that the rotating speed difference between the near roller and the far roller composing the upstream second conveying rollers is larger than the rotating speed difference between the near roller and the far roller composing the downstream second conveying rollers.

Therefore, according to the image forming apparatus G of the present embodiment, after rough correction using the upstream second conveying roller, fine adjustment can be done using the downstream second conveying roller. Consequently, correction processes can be performed without reducing the productivity.

According to the image forming apparatus G of the present embodiment, when the deviation amount and the difference between the loop amounts of the two positions is equal to or less than the predetermined threshold, the speed controller controls the rotating speed of either one of the upstream second conveying roller or the downstream second conveying roller.

Therefore, according to the image forming apparatus G of the present embodiment, correction can be performed by only one of the second conveying rollers when the degree of deviation or bend in the sheet is small. Consequently, it is possible to control the roller easily and suitable correction can be performed according to the situation.

According to the image forming apparatus G of the present embodiment, based on the deviation amount, after controlling the rotating speed of the near roller and the far roller composing the upstream second conveying roller, the speed controller controls so that the relation of which rotating speed is faster between the near roller and the far roller composing the downstream second conveying roller is opposite of the relation of which rotating speed is faster between the near roller and the far roller composing the upstream second conveying roller.

Therefore, according to the image forming apparatus G of the present embodiment, when the deviation of the sheet is corrected, correction can be performed linking the upstream second conveying roller and the downstream conveying roller. Consequently, difficult correction of the deviation can be reliably performed.

An embodiment of the present invention is described in detail above, but the present invention is not limited to the above-described embodiment, and may be suitably modified without leaving the scope of the invention.

(Modification)

For example, when a long sheet with high stiffness is conveyed, in order to reduce the stiffness of the sheet when the sheet is nipped by the upstream loop roller 41 and the downstream loop roller 42, control can be performed to separate the conveying roller (for example, conveying roller 50, etc.) positioned upstream than the upstream loop roller 41 and the downstream loop roller 42 in the conveying direction or the conveying roller (for example, registration roller 43, etc.) positioned downstream than the upstream loop roller 41 and the downstream loop roller 42 in the conveying direction.

Figure 14:
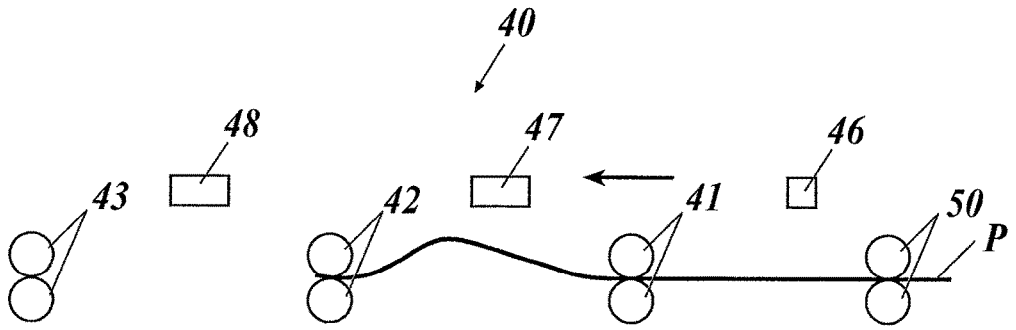
FIG. 14 is a diagram showing an example of maintaining a nipped state of a conveying roller positioned upstream than the upstream loop roller in the conveying direction.

For example, as shown in FIG. 14, until the downstream loop roller 42 nips and conveys the sheet, the controller 11 controls the nipping adjuster 30 to maintain the nipped state in the conveying roller 50 positioned upstream than the upstream loop roller 41 in the conveying direction. Consequently, the conveying power of the sheet is secured.

Figure 15:
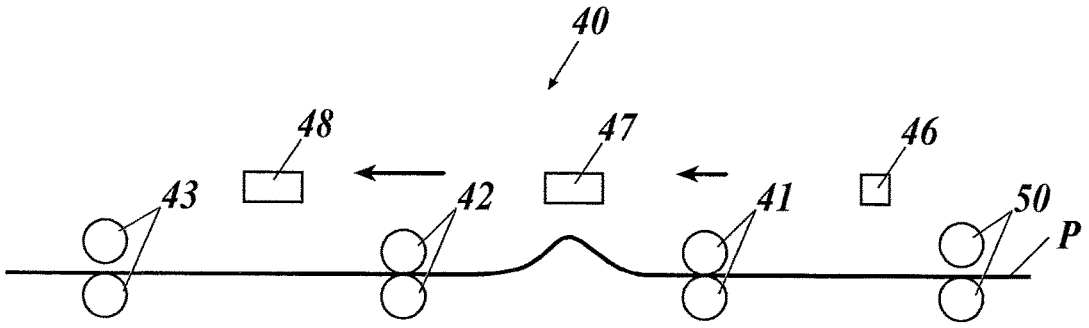
FIG. 15 is a diagram showing an example of conveying rollers positioned upstream than the upstream loop roller in the conveying direction and registration rollers positioned downstream than the upstream loop roller in the conveying direction being separated.

As shown in FIG. 15, after the downstream loop roller 42 nips the sheet and starts conveying of the sheet, the controller 11 controls the nipping adjuster 30 to separate the conveying roller 50 positioned upstream than the upstream loop roller 41 in the conveying direction or the registration roller 43 positioned downstream than the upstream loop roller 41 in the conveying direction so as to release the nipped state. With this, the stiffness of the sheet occurring when the sheet is nipped by the upstream loop roller 41 and the downstream loop roller 42 is reduced. The conveying power of the sheet is secured by the upstream loop roller 41 and the downstream loop roller 42.

After the bend and the deviation caused by the upstream loop roller 41 and the downstream loop roller 42 are corrected, the controller 11 allows the conveying roller 50 and the registration roller 43 to nip the sheet again to secure the conveying power of the sheet.

According to the example shown in FIG. 15, control is performed to separate the conveying roller 50 and the registration roller 43 but the present invention is not limited to the above. That is, control can be performed to also separate the conveying roller positioned upstream than the conveying roller 50 in the conveying direction or the conveying roller positioned downstream than the registration roller 43 in the conveying direction.

As described above, by providing a nip controller (controller 11) which controls pressing and separating of the conveying roller other than the upstream second conveying roller and the downstream second conveying roller based on the deviation amount and the difference of the loop amount in two positions, balance between securing the conveying power and the easiness of correction can be maintained according to the situation of the conveyed sheet, and the correction can be performed without pausing the conveying of the sheet.

According to the above-described embodiment, the deviation sensor 46 is positioned downstream than the conveying roller 50 in the conveying direction and upstream than the upstream loop roller 41 in the conveying direction, but the present invention is not limited to the above. That is, the deviation sensor 46 can be positioned in any position upstream than the upstream loop roller 41 in the conveying direction.

According to the above-described embodiment, two loop amount detectors, that is, the first loop detecting sensor 47 and the second loop detecting sensor 48 are provided, but the present invention is not limited to the above. That is, at least one loop amount detector is provided in a position upstream than the registration roller 43 in the conveying direction and downstream than the upstream loop roller 41 in the conveying direction.

The detailed configuration and the detailed operation of each unit in the image forming apparatus can be suitably modified without leaving the scope of the present invention.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2016-231978 filed on Nov. 30, 2016 is incorporated herein by reference in its entirety.

What is claimed is:

1. An image forming apparatus including an image forming unit which forms an image on a long sheet, the apparatus comprising:

a first conveying roller;

an upstream second conveying roller and a downstream second conveying roller which are positioned upstream than the first conveying roller in a conveying direction, which are positioned adjacent to each other in the conveying direction, and which form a loop on the long sheet;

a deviation amount detector which is positioned upstream than the upstream second conveying roller in the conveying direction and which detects a deviation amount of the long sheet;

a loop amount detector which is positioned upstream than the first conveying roller in the conveying direction, which is positioned downstream than the upstream second conveying roller in the conveying direction, and which detects a loop amount of a loop formed by at least one of the upstream second conveying roller and the downstream second conveying roller in two positions in a width direction; and a speed controller which controls a rotating speed of the upstream second conveying roller and the downstream second conveying roller based on a deviation amount detected by the deviation amount detector and a difference of loop amounts in two positions detected by the loop amount detector, wherein, each of the upstream second conveying roller and the downstream second conveying roller includes a near roller and a far roller positioned aligned in a direction orthogonal to the conveying direction, and the speed controller controls the rotating speed of the near roller and the far roller composing the upstream second conveying roller and the downstream second conveying roller based on the deviation amount and the difference of the loop amounts in the two positions.

2. The image forming apparatus according to claim 1, wherein the speed controller separately controls the rotating speed of the near roller and the far roller composing each of the upstream second conveying roller and the downstream second conveying roller.

3. The image forming apparatus according to claim 2, wherein the speed controller controls the rotating speed so that a rotating speed difference between the near roller and the far roller composing the upstream second conveying roller is larger than a rotating speed difference between the near roller and the far roller composing the downstream second conveying roller when the deviation amount or the difference of the loop amount in the two positions exceeds a predetermined threshold.

4. The image forming apparatus according to claim 2, wherein the speed controller controls either one of the rotating speed of the upstream second conveying roller and the downstream second conveying roller when the deviation amount and the difference of the loop amounts in the two positions are equal to or less than the predetermined threshold.

5. The image forming apparatus according to claim 2, wherein, based on the deviation amount, after the rotating speed of the near roller and the far roller composing the upstream second conveying roller is controlled, the speed controller controls a relation of which rotating speed is faster between the near roller and the far roller composing the downstream second conveying roller to be opposite the relation of which rotating speed is faster between the near roller and the far roller composing the upstream second conveying roller.

6. The image forming apparatus according to claim 1, further comprising a nip controller which controls pressing and separating of the conveying roller other than the upstream second conveying roller and the downstream second conveying roller based on the difference between the deviation amount and the difference of the loop amounts in the two positions.

* * * * *